United States Patent [19]

DeSchane

[11] Patent Number: 4,565,037

[45] Date of Patent: Jan. 21, 1986

[54] INSULATION HOLD-DOWN DEVICE

[76] Inventor: Robert W. DeSchane, 331 - 4th Ave. SW., Perham, Minn. 56573

[21] Appl. No.: 638,263

[22] Filed: Aug. 6, 1984

[51] Int. Cl.[4] ..... E04B 7/18; E04B 7/02

[52] U.S. Cl. ..... 52/95; 98/DIG. 6; 98/37; 52/90; 52/198; 52/696; 52/407; 52/92; 52/303

[58] Field of Search ..... 52/95, 198, 199, 696, 52/406, 407, 90, 743, 302, 303, 92; 98/DIG. 6, 37

[56] References Cited

U.S. PATENT DOCUMENTS

| | | | |
|---|---|---|---|
| 3,863,553 | 2/1975 | Koontz | 52/95 |
| 4,102,092 | 7/1978 | Ward | 98/37 X |
| 4,184,416 | 1/1980 | Koontz | 52/95 |
| 4,189,878 | 2/1980 | Fitzgerald | 52/95 |
| 4,237,672 | 12/1980 | Peterson . | |
| 4,265,060 | 5/1981 | Woodhams | 59/95 |

*Primary Examiner*—John E. Murtagh
*Assistant Examiner*—Caroline Dennison
*Attorney, Agent, or Firm*—Herman H. Bains

[57] ABSTRACT

An insulation hold-down device is provided for insuring circulation of air through vents into the attics or similar spaces of buildings having insulation therein. The hold-down device has a center insulation restraining section and two end attachment flanges. One flange is attached by nailing or other conventional device to the bearing plate of a building while the other attachment flange is attached to the roof panel of the building between rafters. The hold-down device may be formed by stamping from a single piece of sheet metal.

4 Claims, 3 Drawing Figures

INSULATION HOLD-DOWN DEVICE

BACKGROUND OF THE INVENTION

In recent years, the concern with energy conservation has prompted many home owners and builders to attempt to substantially increase the insulation in homes and other buildings. While such is a generally laudible goal, such an increase in insulation can cause problems if proper care is not taken to maintain sufficient ventilation in attic spaces so as to prevent condensation and ice buildup on the roof of the building. Various attempts have been made to solve this problem, and such attempts may be seen in U.S. Pat. Nos. 3,863,553, 4,237,672, 4,184,416 and 4,189,878. While such devices are in the most general sense suitable for accomplishing their intended purpose, those devices have a number of drawbacks which prevent more widespread usage of them. The size associated with most such devices renders them relatively expensive to manufacture and also requires a substantial amount of space. Further, the way such devices are intended to be used requires that those devices be made in special sizes to suit the particular joist spacing employed in a particular building.

It is therefore an object of the instant invention to provide a dedvice which is easily and inexpensively manufactured and which may be easily and quickly applied to the job to perform the intended function of encouraging proper air circulation into and out of the attic space.

SUMMARY OF THE INVENTION

An insulation hold-down is provided and formed from an elongated strip of metal in the preferred embodiment. Ideally, the strip is stamped and is formed with three panels. The central panel forms a substantial majority of the length of the device and is bounded on either end by attachment flanges located at an angle to the central panel. The attachment flanges are provided with means for attachment which may be a hole designed to receive a nail, screw or other conventional fastener or may be provided with an integral tack or the like in which case the device may be applied without the use of additional fastening devices.

In particular, the device is designed to be attached to the building wherein one attachment flange is nailed or otherwise fastened to the bearing plate of the building, and the other attachment flange designed for nailing or other attachment to the roof panel. In between, the restraint panel serves to depress the insulation batt in the region adjacent the bearing plate and hence allow circulation of air over the bearing plate and beneath the roof panel and between the rafters and into the attic space.

Other objects and advantages of the invention will become apparent from the following detailed description and from the appended drawings in which like numbers have been used to describe like parts of the several views.

DESCRIPTION OF THE DRAWING FIGURES

DESCRIPTION OF THE PREFERRED EMBODIMENT

Figure 1:
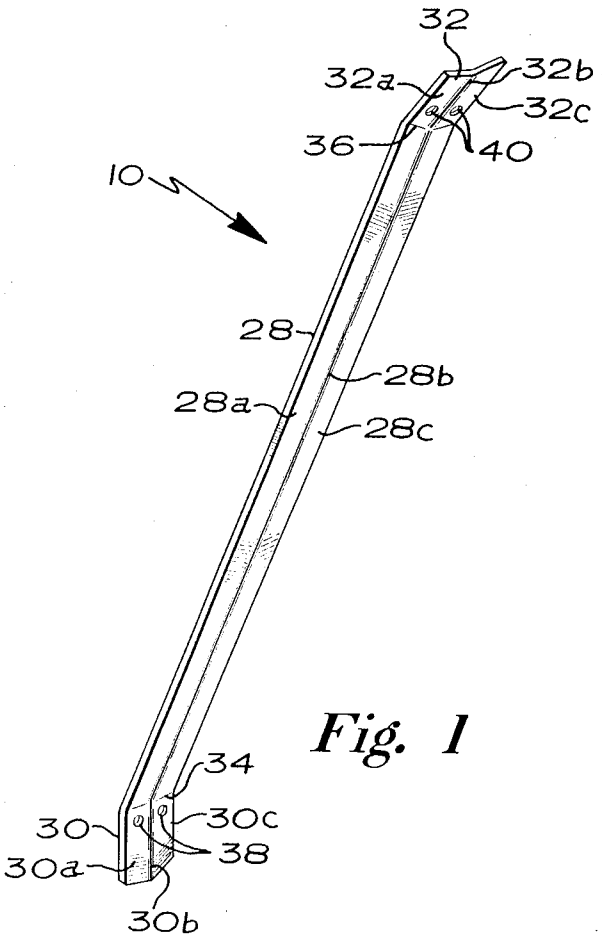
FIG. 1 is a perspective view showing the device of the instant invention.

The insulation hold-down device of the instant invention, generally designated 10, is show in detail in FIG. 1. Hold-down 10 is designed for use generally in a building 12 such as that shown in FIGS. 2 and 3, which building is generally comprised of a bearing plate 14 and joists 16. Batt-type insulation 18 is generally located in such construction between joists 16, insulation 18 having a paper facing 20 on one side thereof. Paper facing 20 is generally several inches wider than the batt 18 on either side thereof and paper facing 20 is thence commonly stapled to the bottom side of joists 16 as can be seen particularly in FIGS. 2 and 3.

Typically, a vent soffit 22 is located underneath the eaves of the building. In order to operate properly, vent soffit 22 must be allowed to communicate with the space above joists 16 in the attic thereby allowing air to flow as shown by the arrow in FIG. 2. In the absence of the instant invention, insulation batt will generally lie directly up against the inner roof panel 26 thereby obstructing flow passage 24 through which the air would normally flow. Such obstruction results in undesirable heat buildup.

The insulation hold-down 10 is comprised generally of a central insulation depressing section 28 flanked by attachment flanges 30 and 32 at either end thereof. Ideally, hold-down 28 is formed from a single stamped piece of sheet metal although, of course, other materials or construction may be utilized if desired. Attachment flanges 30 and 32 are joined to central section 28 at fold lines 34 and 36, respectively.

In the preferred embodiment, the crease line **28*b* divides central section 28 into panels 28*a* and 28*c* while similarly crease lines 30*b* and 32*b* divide flanges 30 and 32 into panels 30*a* and 30*c* and 32*a* and 32*c*. Ideally, attachment flanges 30 and 32 are formed symmetrically so as to allow hold-down 10** to be used and applied in either direction.

As can be seen in FIG. 1, two holes 38 are provided in first attachment flange 30 while two holes 40 are provided in second attachment flange 32.

Figure 3:
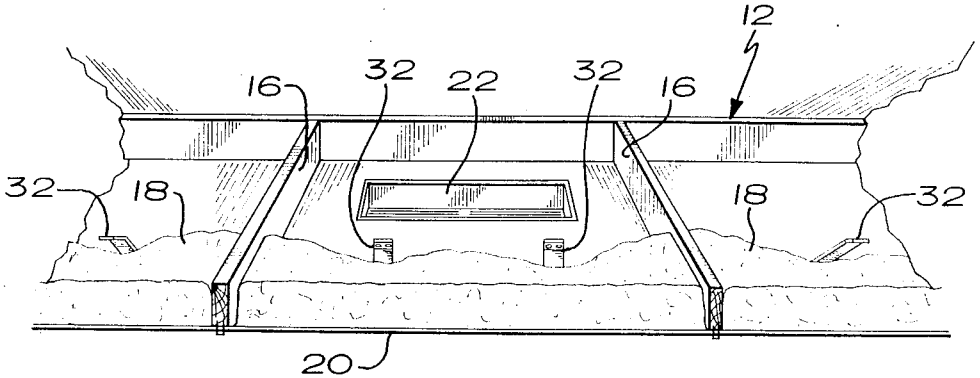
FIG. 3 is a sectional view taken along line 3—3 of FIG. 2.

FIG. 3 shows two hold-down devices 10 being utilized between each set of joists 16. However, this number may vary from one to as many as are desired depending upon the volume of air flow through passage 24 and soffit vent 22 and the distance between joists. In most cases, either one or two hold-down devices 10 will be satisfactory.

Figure 2:
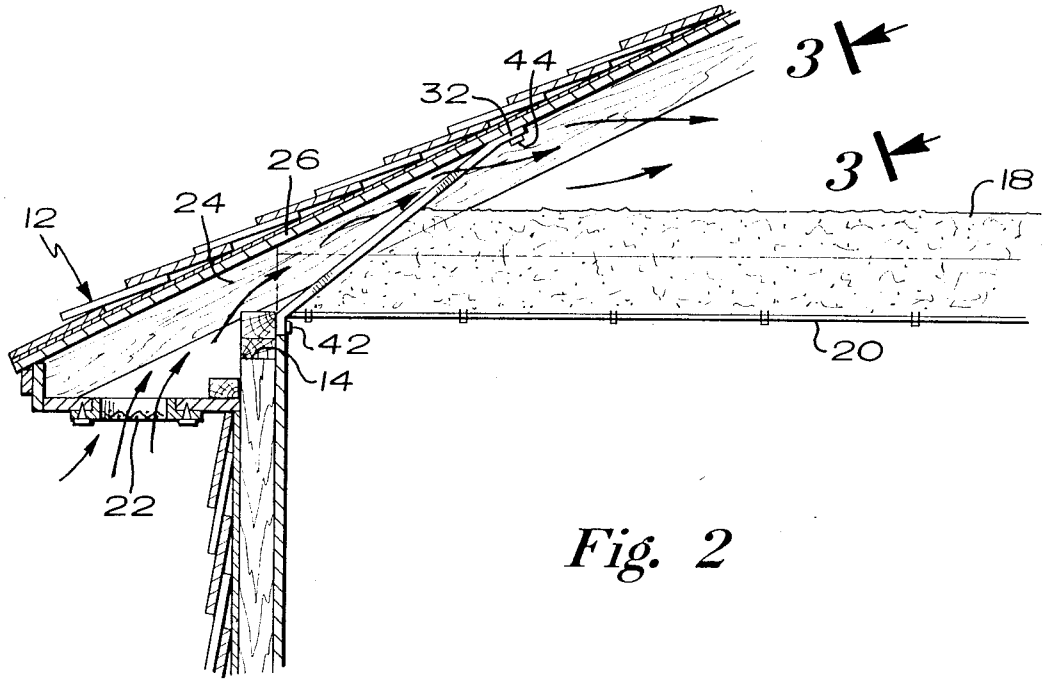
FIG. 2 is a cutaway view showing the invention in place in the roof area of a building.

To install hold-down device 10, the device is placed in the position shown in FIG. 2, ideally prior to the installation of insulation 18. In doing so, a first attachment flange 30 is placed on bearing plate 14 and second attachment flange 32 is placed to face and contact roof panel 26. Thereinafter, at least one attachment means such as a nail 42 is placed into the first hole 38 of first attachment flange 30 and into bearing plate 14. A second attachment member such as a nail 44 may also be placed through hole 40 of second attachment flange 32 into roof panel 26.

It is to be noted that hold-down device 10 may be formed with integral fastening devices such as tacks which are stamped into the sheet metal during manufacture. Such a construction then obviates the need for use of of nails or other fastening devices during attachment. Such construction, however, does require space for shipping and the like.

Also, it is to be noted that FIG. 1 shows a pair of attachment holes 38 and 40 in each attachment flange. By providing a pair of holes, two nails or other attachment devices may be placed in one flange thereby generally positioning the device and obviating the need for nailing the other end. This can be especially helpful when one end of the hold-down device is relatively inaccessible to a hammer. Of course, the hold-down device may be attached simply with a nail at either end if desired.

While preferred embodiment of the present invention has been described, it is understood that various changes, adaptions and modifications may be made therein without departing from the spirit of the invention of the scope of the appended claim.

What is claimed is:

1. An insulation hold-down device in combination with a structure comprising a plurality of spaced apart joists, insulation located between said joists, a bearing plate and a roof panel, said hold-down device comprising:

an elongate insulation hold-down panel positioned between and substantially parallel to a pair of said joists and having first and second ends, said hold-down panel having a width dimension substantially narrower than the spacing between adjacent joists, a first attachment flange integral with said first end and extending at an angle with respect to said panel, a second attachment flange integral with said second end and extending at an angle with respect to said panel, means engaging said first flange and attaching the latter to said bearing plate, and means engaging said second flange for attaching the latter to said roof panel whereby said hold-down panel depresses said insulation located between a pair of joists to form an air passage adjacent said roof panel.

2. The insulation hold-down device of claim 1 wherein said attachment means comprise at least two holes in each said flange and securing elements extending through said holes to engage the bearing plate and roof panel.

3. The insulation hold-down device of claim 1 wherein said attachment means comprises an integral tack in each said flange.

4. The insulation hold-down device of claim 1 wherein said hold-down panel comprises a slight crease running the length thereof.

* * * * *